US009676525B2

(12) United States Patent
Greiner-Perth et al.

(10) Patent No.: US 9,676,525 B2
(45) Date of Patent: Jun. 13, 2017

(54) PROTECTIVE CAP FOR A DISPENSER, AND DISCHARGE DEVICE FOR DISCHARGING PHARMACEUTICAL AND/OR COSMETICAL LIQUIDS

(71) Applicants: Juergen Greiner-Perth, Gottmadingen (DE); Gerald Krampen, Radolfzell (DE); Andi Herz, Eigeltingen-Reute (DE); Sai Shankar, Irvine, CA (US); Antonio O. Mallare, Gardena, CA (US)

(72) Inventors: Juergen Greiner-Perth, Gottmadingen (DE); Gerald Krampen, Radolfzell (DE); Andi Herz, Eigeltingen-Reute (DE); Sai Shankar, Irvine, CA (US); Antonio O. Mallare, Gardena, CA (US)

(73) Assignee: APTAR RADOLFZELL GMBH, Radolfzell (DE)

( * ) Notice: Subject to any disclaimer, the term of this patent is extended or adjusted under 35 U.S.C. 154(b) by 52 days.

(21) Appl. No.: 14/108,570

(22) Filed: Dec. 17, 2013

(65) Prior Publication Data

US 2015/0166224 A1 Jun. 18, 2015

(51) Int. Cl.
*B65D 41/32* (2006.01)
*B65D 51/16* (2006.01)
(Continued)

(52) U.S. Cl.
CPC ..... *B65D 41/32* (2013.01); *B65D 47/2068* (2013.01); *B65D 51/16* (2013.01);
(Continued)

(58) Field of Classification Search
CPC ..... B65D 51/16; B65D 51/18; B65D 83/00; B65D 2205/00; B65D 47/2068;
(Continued)

(56) References Cited

U.S. PATENT DOCUMENTS 3,817,416 A 6/1974 Costa
4,029,231 A 6/1977 Jonsson
(Continued)

FOREIGN PATENT DOCUMENTS

CN 2382677 Y 6/2000
CN 1468189 A 1/2004
(Continued)

OTHER PUBLICATIONS

Form PCT/ISA/206 Invitation to Pay Additional Pees with Annex (Communication Relating to Results of Partial International Search) issued in Application No. PCT/EP2014/078045 in English dated Mar. 16, 2015 (7 pages).
(Continued)

*Primary Examiner* — Nicholas J Weiss
(74) *Attorney, Agent, or Firm* — Flynn, Thiel, Boutell & Tanis, P.C.

(57) ABSTRACT

A protective cap for a dispenser for discharging liquids, wherein the dispenser has a liquid reservoir and an outlet opening through which the liquid is discharged into a surrounding atmosphere. The protective cap has an inner cap and an outer cap, the inner cap having a ventilation opening for communication between an interior of the protective cap and an external environment. Before use, the outer cap is mounted on the inner cap in a first position with the inner cap and the outer cap in sealing contact with each other and the ventilation opening is separated in an airtight and germproof manner from the environment, and the outer cap is movable relative to the inner cap from the first position to a second position in which the inner and outer caps are out of sealing contact with each other and the ventilation opening communicates with the environment.

17 Claims, 6 Drawing Sheets

(51) Int. Cl.
*B65D 83/00* (2006.01)
*B65D 47/20* (2006.01)
*B65D 51/18* (2006.01)

(52) U.S. Cl.
CPC ..... *B65D 51/1672* (2013.01); *B65D 51/1688* (2013.01); *B65D 51/18* (2013.01); *B65D 83/00* (2013.01); *B65D 2205/00* (2013.01)

(58) Field of Classification Search
CPC B65D 41/32; B65D 51/1672; B65D 51/1677; B65D 51/1688; B65D 47/247; B65D 47/265; B65D 41/48
See application file for complete search history.

(56) References Cited

U.S. PATENT DOCUMENTS

| | | | | |
|---|---|---|---|---|
| 4,427,126 | A | 1/1984 | Ostrowsky | |
| 4,463,878 | A | 8/1984 | Crone | |
| 4,726,482 | A | 2/1988 | Barriac | |
| 5,033,647 | A | 7/1991 | Smith | |
| 5,108,007 | A | 4/1992 | Smith | |
| 5,305,900 | A * | 4/1994 | Maguire | B65D 47/0861 215/245 |
| 5,398,829 | A | 3/1995 | Stubbs | |
| 5,785,209 | A | 7/1998 | Guglielmini | |
| 5,853,096 | A | 12/1998 | Bartur et al. | |
| 5,971,182 | A | 10/1999 | Berge | |
| 6,170,683 | B1 * | 1/2001 | Montgomery | B65D 47/0861 215/225 |
| 6,550,626 | B1 | 4/2003 | Randall | |
| 7,188,750 | B2 | 3/2007 | Vogel | |
| 7,243,807 | B2 | 7/2007 | Lin | |
| 8,281,962 | B2 | 10/2012 | Ogawa | |
| 8,794,490 | B2 | 8/2014 | Painchaud | |
| 2003/0168456 | A1 * | 9/2003 | Tomasella | B65D 41/0421 220/257.1 |
| 2004/0011790 | A1 | 1/2004 | Woinarski | |
| 2004/0173556 | A1 | 9/2004 | Smolko et al. | |
| 2008/0302836 | A1 | 12/2008 | Mathis | |
| 2010/0084364 | A1 | 4/2010 | Martin | |
| 2010/0147899 | A1 | 6/2010 | Nardi | |
| 2012/0305559 | A1 * | 12/2012 | Steininger | B65D 47/065 220/253 |
| 2015/0043958 | A1 | 2/2015 | Painchaud et al. | |

FOREIGN PATENT DOCUMENTS

| | | | |
|---|---|---|---|
| CN | 1473127 | A | 2/2004 |
| CN | 101605704 | A | 12/2009 |
| CN | 103429501 | A | 12/2013 |
| DE | 38 29 356 | A1 | 3/1990 |
| DE | 20 2005 004 595 | U1 | 8/2006 |
| DE | 10 2011 086 755 | A1 | 5/2013 |
| FR | 2 988 015 | | 9/2013 |
| WO | WO 98/23496 | A1 | 6/1998 |
| WO | WO 2006/087740 | A1 | 8/2006 |
| WO | WO 2006/094415 | A1 | 9/2006 |

OTHER PUBLICATIONS

Notification of Transmittal of International Search Report and Written Opinion issued in Application No. PCT/EP2014/078045 date of mailing Jun. 29, 2015 (1 page).
International Search Report issued in Application No. PCT/EP2014/078045 date of mailing Jun. 29, 2015 (6 pages).
Written Opinion of International Searching Authority issued in Application No. PCT/EP2014/078045 date of mailing Jun. 29, 2015 (11 pages).
Office Action of German Patent Office issued in German Application No. 10 2014 201 696.7 dated Jun. 27, 2014 (5 pages).

* cited by examiner

PROTECTIVE CAP FOR A DISPENSER, AND DISCHARGE DEVICE FOR DISCHARGING PHARMACEUTICAL AND/OR COSMETICAL LIQUIDS

FIELD OF APPLICATION AND PRIOR ART

The invention relates to a protective cap for a dispenser and to a discharge device comprising a dispenser for discharging pharmaceutical and/or cosmetical liquids. A dispenser of this kind comprises a liquid reservoir and an outlet opening through which the liquid can be discharged into a surrounding atmosphere.

A liquid stored in the liquid reservoir will be conveyed for discharge in the direction of the outlet opening, which can be done using many different mechanisms. Thus, the liquid reservoir can be designed as a squeeze bottle, of which the content can be placed under pressure by deformation of the walls. A separate pump device can also be used.

Dispensers of the kind in question are known from the prior art, for example from DE 10 2011 086 755 A1. The dispenser shown in DE 10 2011 086 755 A1 comprises an outlet channel which connects the liquid reservoir to the outlet opening, and an outlet valve which is arranged in the outlet channel and which opens depending on pressure or can be manually actuated, wherein the outlet valve, in the closed state, closes the outlet channel. The outlet valve divides the outlet channel into a first portion and a second portion, wherein the second portion adjoins the outlet opening and extends in the direction of the liquid reservoir as far as the outlet valve. In other configurations, the second portion corresponds to a drop-formation surface at the outlet opening.

In each case, the outlet valve has the effect that, after it has been closed, no liquid which has passed into the second portion of the outlet channel on a side of the outlet valve directed away from the liquid reservoir, or which has remained in the area around the outlet opening outside the outlet channel, can be sucked back into the dispenser. A possible contamination of the content of the liquid reservoir by liquid residues that have been sucked back is thereby prevented. The residual liquid therefore remains in an area accessible from the outside. Contact with the atmosphere results in rapid drying of the residual liquid.

In order to permit rapid drying of the residual liquid even when a protective cap is fitted on the dispenser, it is known from DE 10 2011 086 755 A1 to provide the protective cap of the dispenser with ventilation openings that create a permanent connection between the area where a residual liquid may remain and an external environment. However, the ventilation openings for their part may again cause contamination.

In order to avoid contamination according to DE 10 2011 086 755 A1, surfaces of the outlet channel downstream of the outlet valve, as viewed in the discharge direction, and/or an outer surface of a housing surrounding the outlet opening are designed to be antibacterial, wherein the antibacterial state is limited exclusively to these surfaces.

OBJECT AND SOLUTION

The object of the invention is to make available a protective cap for a dispenser, which protective cap permits rapid drying and alleviates the problems of admission of microorganisms into the protective cap. The object of the invention is also to make available a discharge device comprising a dispenser with a corresponding protective cap.

According to a first aspect, a protective cap for a dispenser is provided, wherein the protective cap comprises an inner cap and an outer cap, the inner cap has at least one ventilation opening for communication between an interior of the protective cap and an external environment, and, before a first use, the outer cap is mounted on the inner cap in a first position in which the inner cap and the outer cap are sealingly in contact with each other and the at least one ventilation opening is separated in an airtight and germproof manner from the environment, and the outer cap is movable relative to the inner cap from the first position to at least a second position in which the inner cap and the outer cap are not sealingly in contact with each other and the at least one ventilation opening communicates with the environment.

According to a second aspect, a discharge device is created comprising a dispenser for discharging pharmaceutical and/or cosmetical liquids, with a liquid reservoir and an outlet opening through which the liquid can be discharged into a surrounding atmosphere, and a protective cap with an inner cap and an outer cap, wherein the inner cap has at least one ventilation opening for communication between an interior of the protective cap and an external environment, wherein, before a first use, the outer cap is mounted on the inner cap in a first position in which the inner cap and the outer cap are sealingly in contact with each other and the at least one ventilation opening is separated in an airtight and germproof manner from the environment, and the outer cap is movable relative to the inner cap from the first position to at least a second position in which the inner cap and the outer cap are not sealingly in contact with each other and the at least one ventilation opening communicates with the environment in an airtight and germproof manner.

Rapid drying of the residual liquid is achieved by virtue of the communication between the interior of the protective cap, more precisely of the inner cap, and the external environment. The invention is also based on the knowledge that, before a first use and during storage, transport, etc., germs can gather on the protective cap over the course of time. The quantity of germs that have gathered is dependent, among other things, on the period of time before a first use and on a microbial burden of the environment. If germs are left to gather, this can lead to germs entering the interior of the protective cap via a ventilation opening.

Germs within the meaning of the present invention are to be understood as all microbial pathogens, in particular bacteria and viruses. In the context of the application, a germproof and airtight closure or a germproof and airtight seal is to be understood as a seal with which there is a leakage rate of less than or equal to $10^{-6}$ mbar l/s during storage of the dispenser under normal or standard conditions. A test of impermeability to germs is carried out, for example, in accordance with DIN 58953. In other embodiments, the sealing element is designed in such a way that the provisions of standards DIN EN ISO 11607, DIN EN 868 are met.

The dispenser is suitable in particular for unpreserved ophthalmic agents. In one embodiment, the dispense comprises an outlet channel which connects the liquid reservoir to the outlet opening, and an outlet valve which opens depending on pressure or can be manually actuated and which is arranged in the outlet channel and, in a closed state, closes the outlet channel, The outlet valve prevents entry of germs into the liquid reservoir. The outlet valve is preferably an outlet valve which opens depending on pressure and which is opened by the pressure of the liquid in the liquid reservoir, or of a partial amount removed therefrom, and which automatically closes again as soon as the corresponding overpressure with respect to the environment ends. However, other types of valves can also be used here in principle. For example, provision can be made that the liquid in the liquid reservoir is permanently under pressure and the dispenser is maneuvered via a handle, of which the manual actuation opens the outlet valve. The outlet valve prevents discharged liquid from being sucked back into the liquid reservoir.

Before a first use, the outer cap is mounted on the inner cap in a first position. The outer cap is to be moved from the first position relative to the inner cap by a user. In one embodiment, the outer cap is completely separated from the inner cap. In another embodiment, the outer cap is transferred relative to the inner cap to a position in which, although the outer cap is still connected to the inner cap, the inner cap and outer cap are not sealingly in contact with each other, such that the at least one ventilation opening of the inner cap communicates with the environment.

In one embodiment, provision is made that at least one of the inner cap and the outer cap has a blocking element that counteracts a movement of the outer cap relative to the inner cap to the first position. The blocking element prevents or impedes at least a movement of the outer cap to the first position in which the at least one ventilation opening is separated from the environment. This ensures that, during the use of the dispenser, the outer cap does not permanently close the at least one ventilation opening.

In one embodiment, the at least one blocking element is adjustable between a blocking position, in which a movement of the outer cap relative to the inner cap is blocked, and a release position, in which the outer cap is movable relative to the inner cap to the first position, wherein the blocking element is forced into the blocking position. In one embodiment, the blocking element is forced into the blocking position by means of a spring element. In advantageous embodiments, the blocking element is made from an elastically deformable material and is forced into the blocking position on account of elastic restoring forces.

In one embodiment, provision is made that the at least one blocking element is arranged on the outer cap, and the inner cap has at least one complementary opening, wherein, in order to allow a movement of the outer cap relative to the inner cap to the first position, the at least one blocking element can be guided into the at least one complementary opening in the release position. During assembly of the discharge device by a filler, the outer cap can be mounted on the inner cap in order thereby to seal the interior of the protective cap before a first use. The movement of the at least one blocking element to the release position is preferably complex, in order to minimize the chances of the outer cap being fitted back in place by a user.

In an advantageous embodiment, the at least one blocking element is designed as a radially outwardly protruding tab. Tabs of this kind can be formed inexpensively on an outer cap designed as an injection-molded part and/or in an inner cap designed as an injection-molded part.

In another embodiment, at least one protection element is assigned to at least one of the blocking elements in order to avoid a manual operation of said blocking element. Before a first use, the outer cap is removed. The tabs are elastically deformable for allowing a removal of the outer cap by the user. After removal of the outer cap, the blocking elements are forced into the blocking position on account of elastic restoring forces and hinder a reassembly of the outer cap onto the inner cap. The protection elements hinder a user from manually forcing the blocking elements in the release position. In one embodiment, several U-shaped protection elements are provided, each assigned to one blocking element for covering the blocking element at least partially. In other embodiments, an outer ring is provided covering all blocking elements. In a preferred embodiment, two L-shaped protection ribs are assigned to each blocking element.

In another embodiment, the outer cap is designed in one piece, in particular integrally, with a tamper-evident safety device which, before a first use of the dispenser, has to be separated at least partially irreversibly from the dispenser. In the context of the application, "in one piece" designates two separately produced parts that are mechanically connected. Integrally designates shaping as one component in one production process. A tamper-evident safety device designates a safety device which is fitted on the dispenser and prevents use of the dispenser. The tamper-evident safety device has to be removed to allow use, wherein the tamper-evident safety device is at least partially destroyed. In the context of the application, destruction also designates a visible deformation or the like. As a result of the destruction, it is in any case apparent to the user that the dispenser is not in its original state and that the quality of the stored liquid is not guaranteed. As a result of the outer cap being designed in one piece, in particular integrally, with the tamper-evident safety device, it is ensured that the outer cap is removed before a first use by the user. At the same time, an undamaged tamper-evident safety device also shows the user that the interior has been kept free of germs up to the time of a first use.

In one embodiment, the tamper-evident safety device has a first segment and a second segment, which are each ring-shaped, wherein the second segment is arranged between a portion of the outer cap and the first segment, and the second segment is connected to the first segment and to the outer cap by means of predetermined breaking points. In other words, a circumferential segment is provided that has to be removed to allow use of the dispenser. The first segment is preferably connected to the dispenser such that the connection cannot be undone without destruction, and it prevents the outer cap from being pulled off. After the second segment has been removed, the outer cap can be pulled off. The outer cap is dimensioned in such a way that, after removal of the second segment, it is no longer possible for the outer cap to be sealingly fitted.

In another embodiment, the outer cap has a coupling geometry for connecting it to the dispenser such that the connection cannot be undone without destruction, and the tamper-evident safety device is designed in the form of predetermined breaking points extending at least partially in the longitudinal direction on the outer cap. The tamper-evident safety device has to be removed by forces in the longitudinal direction. The outer cap is partially or completely destroyed, which prevents it from being sealingly fitted back in place.

BRIEF DESCRIPTION OF THE DRAWINGS

Further advantages and aspects of the invention will become clear not only from the claims but also from the following description of preferred illustrative embodiments of the invention, which are explained below with reference to the figures. The same reference signs are used in the drawings for identical or similar components. Features described or shown as part of one illustrative embodiment can likewise be used in another illustrative embodiment in order to obtain a further configuration of the invention. In the drawings:

DETAILED DESCRIPTION OF THE ILLUSTRATIVE EMBODIMENTS

Figure 1:
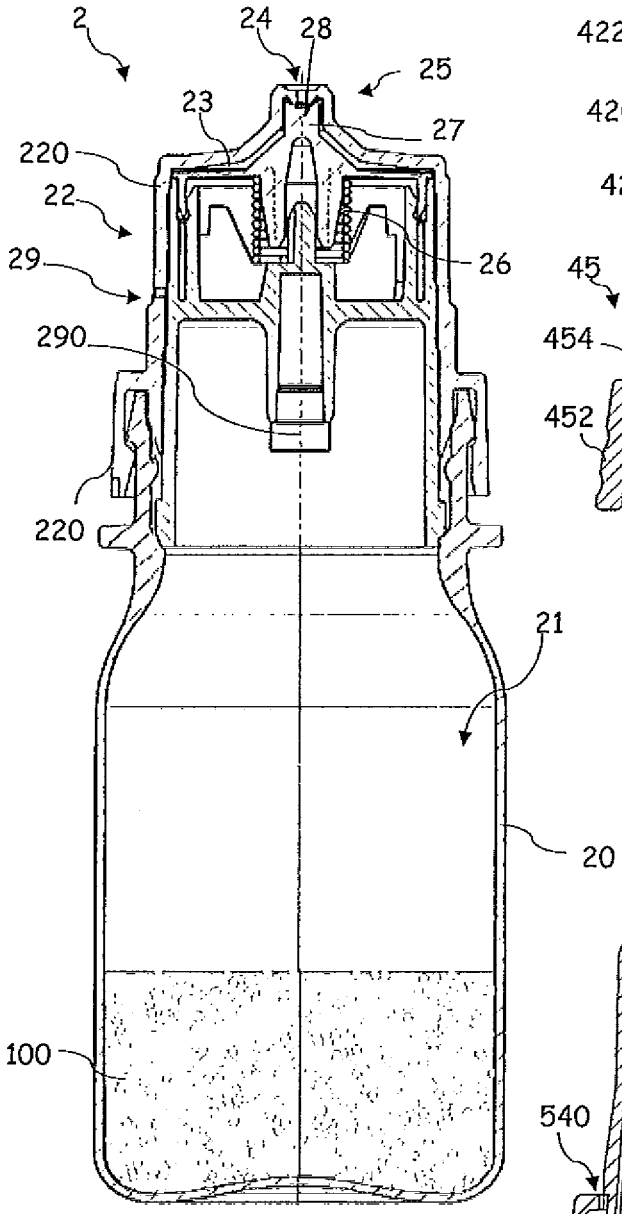
FIG. 1 shows a cross-sectional view of a dispenser for discharging pharmaceutical and/or cosmetical liquids.

FIG. 1 first shows a dispenser 2 for discharging pharmaceutical and/or cosmetical liquids, which dispenser is suitable in particular for unpreserved ophthalmics.

This dispenser 2 has a liquid reservoir 21 delimited by a container body 20. The liquid 100 is stored in the liquid reservoir 21. An outlet assembly 22 is mounted on the container body 20 and secured by means of a latching connection. This outlet assembly 22 serves the purpose of conveying liquid from the liquid reservoir 21 through an outlet channel 23 to an outlet opening 24. The outlet opening 24 shown is designed as a drop-formation surface and widens conically in the discharge direction.

In the view in FIG. 1, the sectional plane means that only a final portion of the outlet channel 23 is shown. Arranged in the outlet channel 23 is an outlet valve 25 which, in a closed state, closes the outlet channel 23, such that liquid located downstream of the outlet valve 25 in the discharge direction cannot pass back into the liquid reservoir 21. The outlet valve 25 shown comprises a valve body 27, which is adjustable counter to the force of a restoring spring 26 and which cooperates with a valve seat 28 formed on a housing wall. An inward flow of air into the liquid reservoir 21 for pressure compensation takes place via a ventilation opening 29 in a housing 220 of the outlet assembly 22. A filter element 290 is arranged in a ventilation path. In advantageous embodiments, the filter element 290 comprises a liquid filter pointing toward the liquid reservoir 21, and a bacterial filter pointing away from the liquid reservoir 21 and having a separation limit of ca. 0.2 μm, such that bacteria measuring ca. 0.2 to ca. 5 μm are safely held back by the bacterial filter.

The dispenser 2 shown is designed as a squeeze bottle. This dispenser 2 is used by turning it over with the outlet opening 24 facing downward. Walls of the container body 20 are then squeezed together in order to apply pressure to the liquid 100 in the liquid reservoir 21. This pressure causes the outlet valve 25 to open. More exactly, as soon as the liquid pressure in a portion of the outlet channel 23 upstream of the outlet valve 25 is high enough, the valve body 27 is shifted by this pressure counter to the force of the restoring spring 26 and clears the way for the liquid in the direction of the outlet opening 24.

After a discharge, the outlet valve 25 is closed again. Generally, a residue of the liquid, the so-called residual drop, remains on the outlet opening 24, designed as drop-formation surface, and in a portion of the outlet channel 23 assigned to the outlet opening 24 and downstream of the outlet valve 25 in the discharge direction. A return flow into the liquid reservoir 21 is not possible on account of the outlet valve 25 that opens depending on pressure. Without fitting a protective cap, the residual drop can quickly dry up.

Figure 2:
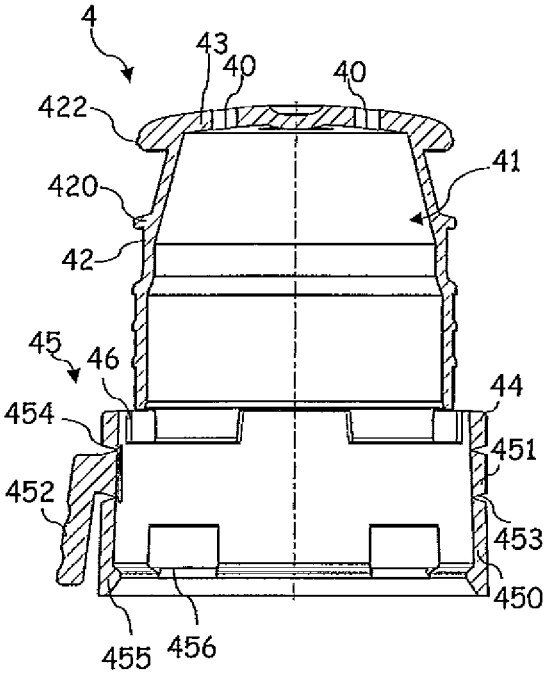
FIG. 2 shows an inner cap of a protective cap for the dispenser from FIG. 1 according to a first illustrative embodiment.
Figure 3:
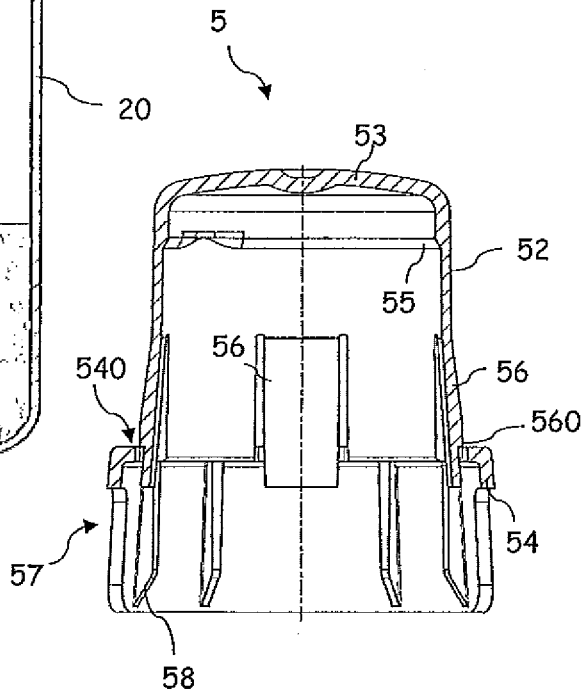
FIG. 3 shows an outer cap of a protective cap for the dispenser from FIG. 1 according to a first illustrative embodiment.

The protective caps 3 according to the invention are in several parts, comprising an inner cap 4, shown on its own in FIG. 2, and an outer cap 5 that can be fitted onto the inner cap 4 and that is shown in FIG. 3.

The inner cap 4 shown in FIG. 2 has a plurality of ventilation openings 40 for communication between an interior 41 and an external environment. The inner cap 4 comprises a substantially sleeve-shaped portion 42, a cover portion 43 connected to the latter, and, lying opposite the cover portion 43, a shoulder portion 44 adjoining the sleeve-shaped portion 42. In the inner cap 4 according to FIG. 2, the ventilation openings 40 are provided on the cover portion 43. The number of the ventilation openings 40 can be chosen as deemed suitable by a person skilled in the art for achieving good ventilation of the interior 41. In the embodiment according to FIG. 2, the inner cap 4 has four uniformly distributed ventilation openings 40, of which only two are visible in FIG. 2. For ease of handling, ribs 420 are arranged on the sleeve-shaped portion 42.

The inner cap 4 is produced as an injection-molded part and has a tamper-evident safety device 45, which has to be removed at the time of a first use. The tamper-evident safety device 45 has a first segment 450, a second segment 451 arranged between the first segment 450 and the shoulder portion 44 of the inner cap 4, and also a tear-open tab 452. Predetermined breaking points 453, 454 are provided between the first segment 450 and the second segment 451 and also between the second segment 451 and the shoulder portion 44. On an inner wall of the first segment 450, latch elements 455 are provided for latching onto the dispenser 2 according to FIG. 1, and also slits 456 into which detent springs of the dispenser 2 are inserted. The latch elements 455 are designed in such a way that they prevent detachment of the inner cap 4 and/or pulling-off of the outlet assembly 22 from the container body 20 without removal or destruction of the tamper-evident safety device 45. A manipulation or unauthorized access to the liquid reservoir 21 is discernible from a destruction of the tamper-evident safety device 45 of parts thereof. Before a first use, the tamper-evident safety device 45 is separated at the predetermined breaking points 453, 454 by application of a force on the tear-open tab 452, and the second segment 451 is irreversibly removed.

After removal of the first segment 451, the inner cap 4 is detachable for use of the dispenser 2. The inner cap 4 is designed in such a way that said cap 4 can be repeatedly detached from and clamped back onto the dispenser 2. For this purpose, the inner cap 4 is slightly deformed when fitted, such that the elastic restoring forces of an inner cap 4 made from plastic generate a clamping action. In other embodiments, latching elements are provided for this purpose.

The outer cap 5 according to FIG. 3 can be fitted onto the inner cap 4. In the illustrative embodiment shown, the sleeve-shaped portion 42 of the inner cap 4 is provided with a sealing area 422, which cooperates, in the manner described below, with a sealing area 55 of the outer cap 5 shown in FIG. 3. Moreover, recesses 46 which serve to receive the outer cap 5 according to FIG. 3 are provided on the shoulder portion 44.

Figure 4:
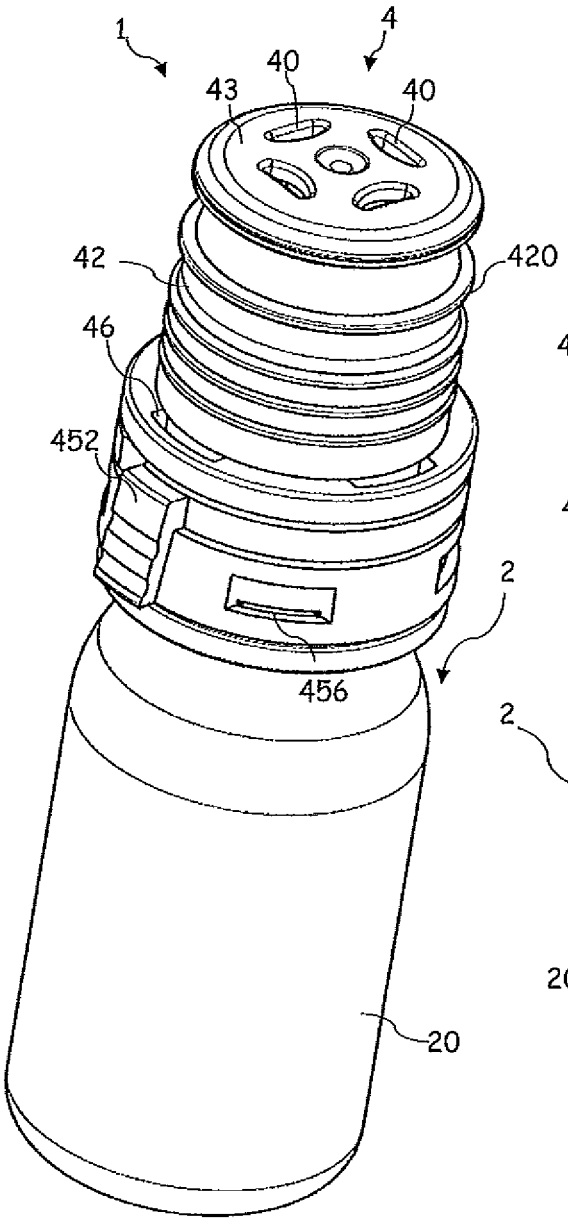
FIG. 4 shows a perspective overall view of a discharge device with a dispenser from FIG. 1 and with an inner cap according to a second illustrative embodiment.
Figure 5:
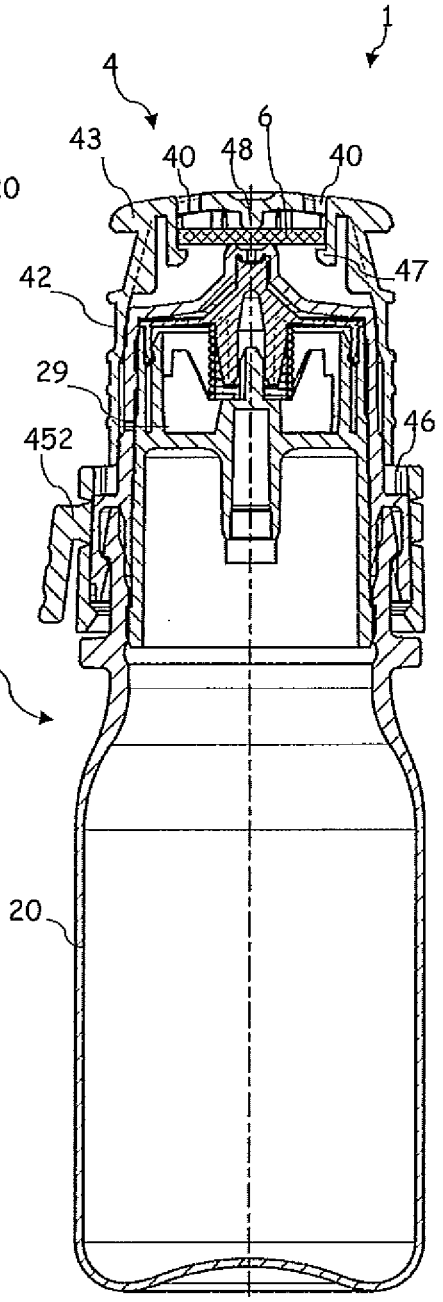
FIG. 5 shows a cross-sectional view of the discharge device from FIG. 4.

FIGS. 4 and 5 show a perspective view and a cross-sectional view, respectively, of the dispenser 2 with a fitted inner cap 4 similar to FIG. 2. For a description of the dispenser 2, reference is made to the above. In contrast to the design according to FIG. 2, the inner cap 4 according to FIGS. 4 and 5 has an absorber element 6 which is arranged, parallel to the cover portion 43 of the inner cap 4, on an inner face of the cover portion 43. In the fitted state as shown in FIG. 5, the absorber element 6 touches the outlet opening 24 and takes up liquid from the outlet opening 24. By virtue of the large surface area, the absorber element 6 thus supports drying of the residual liquid. For securing the absorber element 6, in the illustrative embodiment shown, latching arms 47 are provided on the inner cap on the inside of the cover portion 43. The latching arms 47 protrude from the cover portion 43 in the longitudinal direction of the inner cap 4. To apply the absorber element 6, the latching arms 47 are elastically deformed. A projection 48 is also provided on the cover portion 43 and forces the absorber element 6 into contact with the outlet opening 24.

As can also be seen from FIG. 5, the inner cap 4 preferably bears on the dispenser 2 in such a way that the ventilation opening 29 is sealed off with respect to the environment and with respect to the outlet opening 24 when the inner cap 4 is fitted.

The outer cap 5 is described below with reference to FIG. 3. The outer cap 5 comprises a substantially sleeve-shaped portion 52, a cover portion 53 connected to the latter, and, lying opposite the cover portion 53, a shoulder portion 54 adjoining the sleeve-shaped portion 52. The portions are chosen such that the outer cap 5 can be fitted onto the inner cap 4, wherein a sealing area 55 on an inner jacket surface of the outer cap 5 bears sealingly on the inner cap 4, more precisely on the sealing area 422 of the inner cap 4, such that an area of the ventilation openings 40 is separated from the environment. The outer cap 5 has a plurality of blocking elements 56, which are distributed about the circumference, are designed as tabs and, starting from the sleeve-shaped portion 52, extend in the direction of the shoulder portion 54 and, through recesses 540 in the transition area to the shoulder portion 54, into an interior of the shoulder portion 54. When the outer cap 5 is fitted onto the inner cap 4, the blocking elements 56 engage in the recesses 46. In the illustrative embodiment shown, four blocking elements 56 are distributed uniformly about the circumference. In other embodiments, a greater number or blocking elements or fewer blocking elements are provided for this purpose. The blocking elements 56 are pretensioned radially outwards and have a projection 560. On the shoulder portion 54, recesses 57 are provided through which the tear-open tab 452 of the inner cap 4 projects, in order to permit access to the tear-open tabs 452 when the outer cap 5 is fitted in place. To increase a stability of the outer cap 5, webs 58 extending in the longitudinal direction of the outer cap 5 are provided on an inner jacket surface of the shoulder portion 54.

Figure 6:
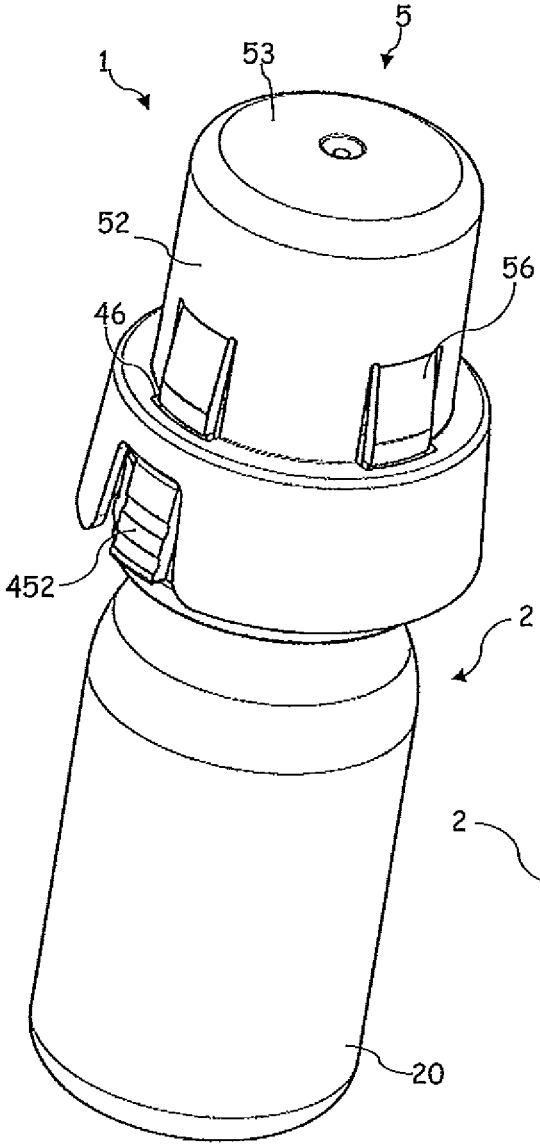
FIG. 6 shows a perspective overall view of the discharge device from FIG. 4 with a fitted outer cap.
Figure 7:
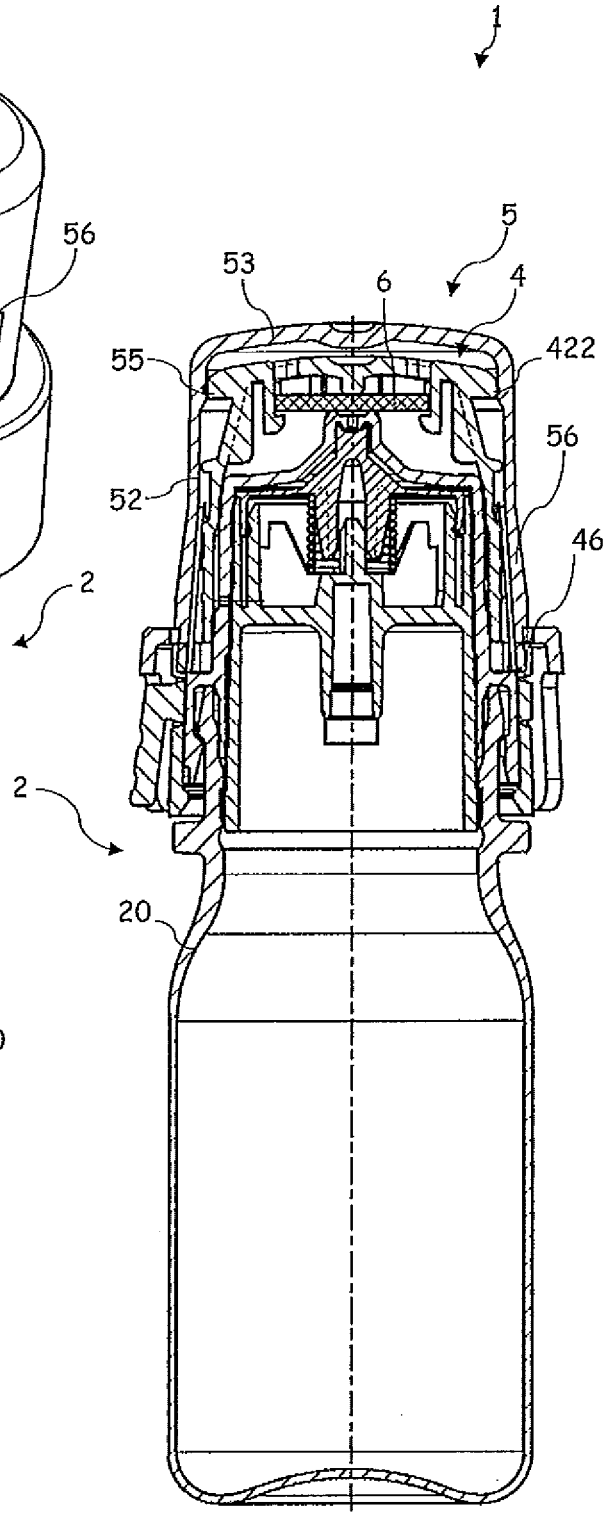
FIG. 7 shows a cross-sectional view of the discharge device from FIG. 6.

FIGS. 6 and 7 show a perspective view and a cross-sectional view, respectively, of the dispenser 2 from FIGS. 4 and 5 with a fitted outer cap according to FIG. 3. As can be seen from FIGS. 6 and 7, the blocking elements 56 are forced radially inward, counter to the pretensioning, and engage in the recesses 46 of the inner cap 4.

Figure 8:
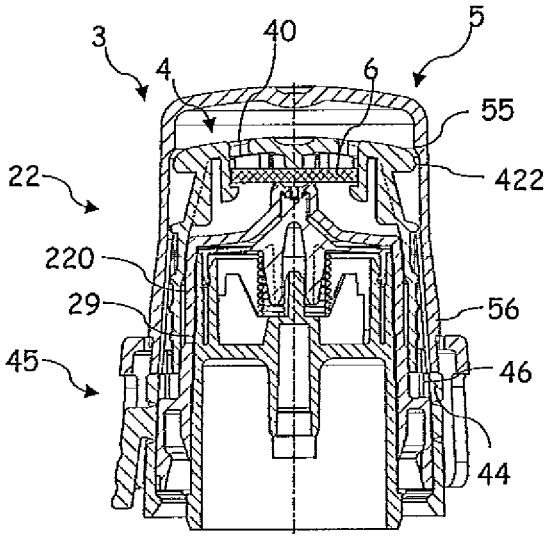
FIG. 8 shows a cross-sectional view of an outlet assembly of the discharge device from FIG. 6 with the outer cap partially detached.

FIG. 8 shows an outlet assembly 22 with a protective cap 3 fitted thereon and comprising an inner cap 4 and an outer cap 5 according to FIGS. 6 and 7, wherein the outer cap 5, for removal, has been moved relative to the inner cap 4 from the first position, shown in FIGS. 6 and 7, to a second position. In this second position, the sealing area 55 of the outer cap 5 no longer bears sealingly on the sealing area 422 of the inner cap 4, and the ventilation openings 40 communicate with the environment. In the second position of the outer cap 5, the inner cap 4 also bears on the housing 220 of the outlet assembly 22 in such a way that the ventilation opening 29 is sealed off with respect to the environment and with respect to the outlet opening 24. Because of the movement of the outer cap 5, the free ends of the blocking elements 56 are no longer guided in the recesses 46 and, because of the pretensioning, they are moved radially outward. The ends of the blocking elements 56 thus come to lie on the shoulder area 44 of the inner cap 4, and, because of the contact between the free ends of the blocking elements 56 and the shoulder area 44, it is not possible for the outer cap 5 to be fitted back in place onto the inner cap 4 to seal the ventilation openings 40.

Figure 9:
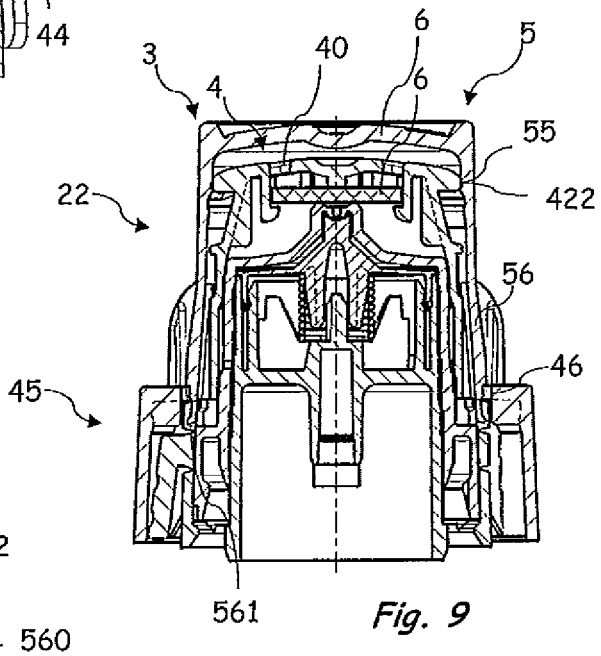
FIG. 9 shows a cross-sectional view of an alternative embodiment of an outlet assembly with a protective cap.
Figure 10:
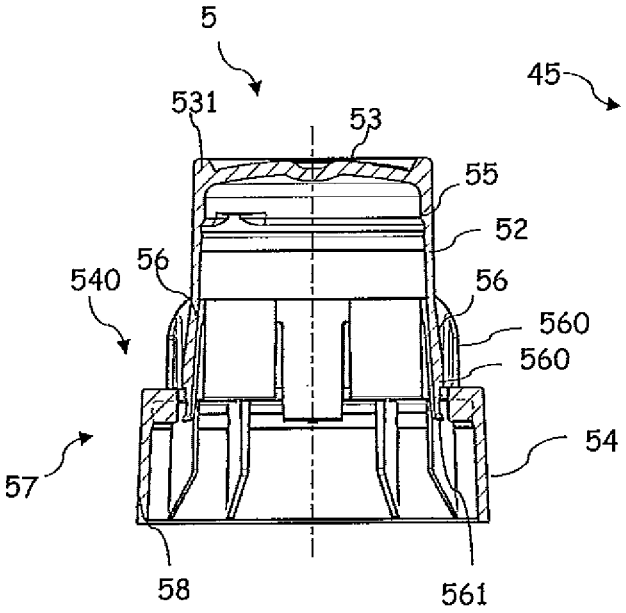
FIG. 10 shows an outer cap of a protective cap for the outlet assembly from FIG. 9.
Figure 11:
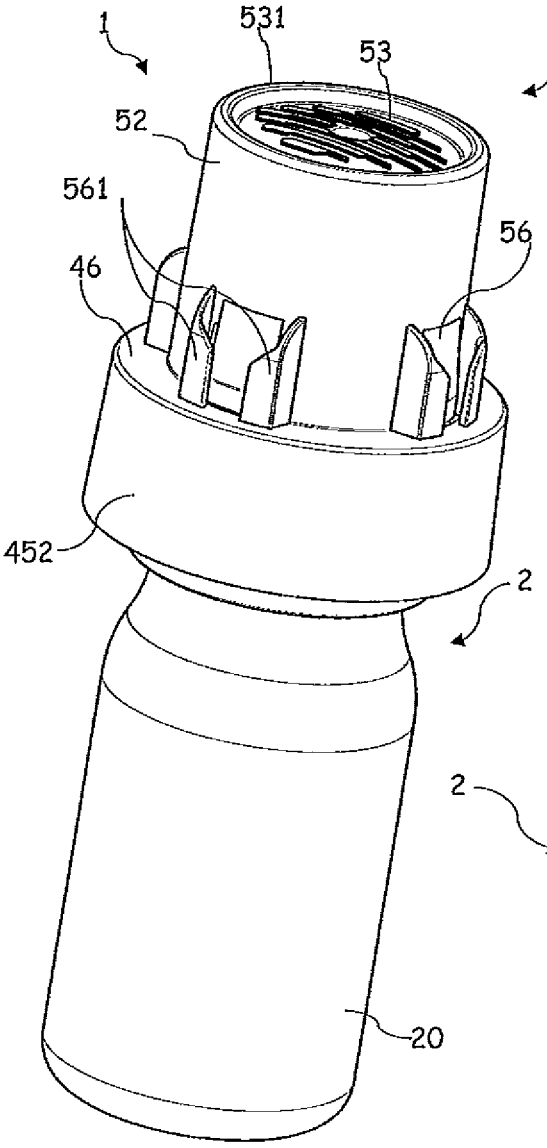
FIG. 11 shows a perspective overall view of the discharge device with an outlet assembly from FIG. 9.
Figure 12:
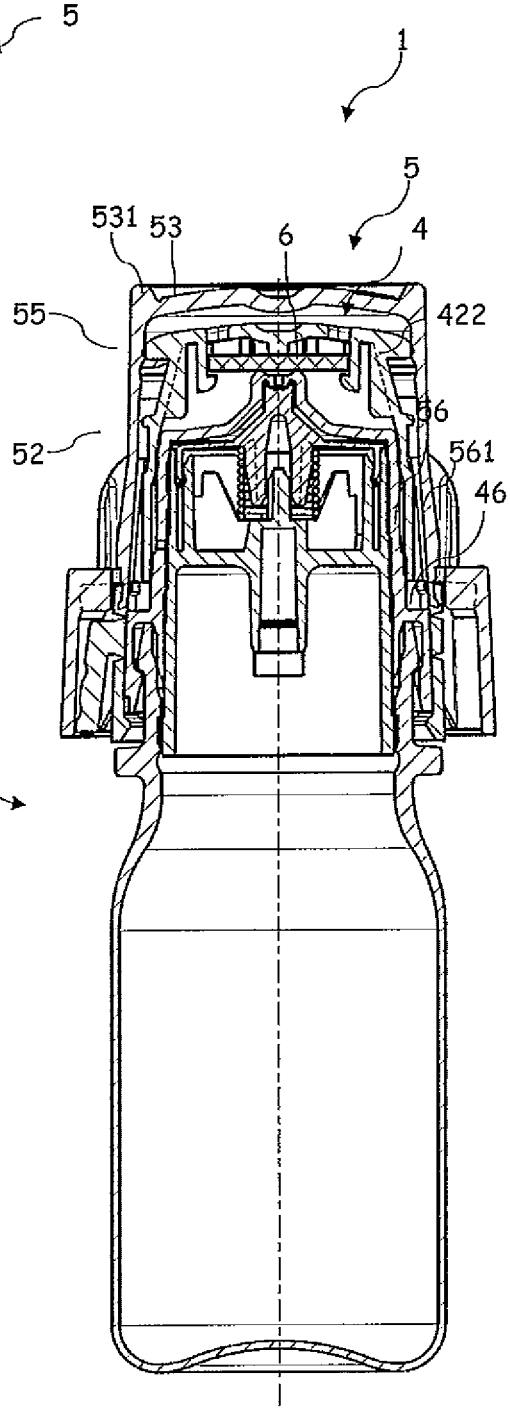
FIG. 12 shows a cross-sectional view of the discharge device from FIG. 11.

FIG. 9 shows an outlet assembly 22 similar to FIG. 8 with a protective cap 3 fitted thereon. The protective cap 3 comprises an inner cap 4 and an outer cap 5, wherein the outer cap 5 is arranged in the first position. The outer cap 5 is shown in detail in FIG. 10. FIGS. 11 and 12 show a perspective view and a cross-sectional view, respectively, of the dispenser 2 from FIGS. 4 and 5 with a fitted outer cap according to FIG. 10.

The inner cap 4 of FIGS. 9 to 12 corresponds to the inner cap 4 shown in FIGS. 1 to 8. The outer cap 5 is similar to the outer cap 5 of FIGS. 1 to 8. For the same or similar elements, identical reference numbers are used and a detailed description is omitted. The outer shape of the cover portion 53 of the outer cap 5 of FIGS. 1 to 8 and the outer cap 5 of FIGS. 9 to 12 differ. The cover portion 53 of the outer cap 5 of FIGS. 9 to 12 has a circumferential rim 531. In other embodiments, the outer shape of the cover portion 53 is identical to that of the previous figures.

The outer cap 5 shown in FIGS. 9 to 12 is also provided with blocking elements 56, which in the first position extend into the recesses 46 of the inner cap 4 as shown in FIG. 9. In contrast to the previous embodiment, the distal ends of the blocking elements 56 are provided with material thinning. Due to the material thinning, an elastic deformation of the blocking elements 56 due to a contact with the inner cap 4 in the first position is reduced. Hence, after removal of the outer cap 5, the elastic restoring forces will reliably force the blocking elements 56 into the blocking position 56, even after long storing time with the outer cap 5 in the first position. In addition, at the distal ends of the blocking elements 56, a guiding edge 561 is provided, which support a guidance of the blocking elements radially outwards in case a user attempts to reassemble the outer cap 5 with the inner cap 4 after a first removal.

Further, in order to avoid that a user manually deforms the blocking elements 56 in order to achieve a reassembly, two L-shaped protection ribs 562 are assigned to each blocking element 56. The L-shaped protection elements are provided with a first leg projecting radially and a second leg projecting tangentially, each. The second legs of the L-shaped protection elements 562 are arranged with a gap in between, which gap is chosen sufficiently small to prevent a manual operation of the blocking elements 56. The shape of the protection elements may be chosen appropriately. For example, in other embodiments, U-shaped protection elements are provided. In still another embodiment, a ring shaped protection element is provided covering simultaneously all blocking elements 56.

Figure 13:
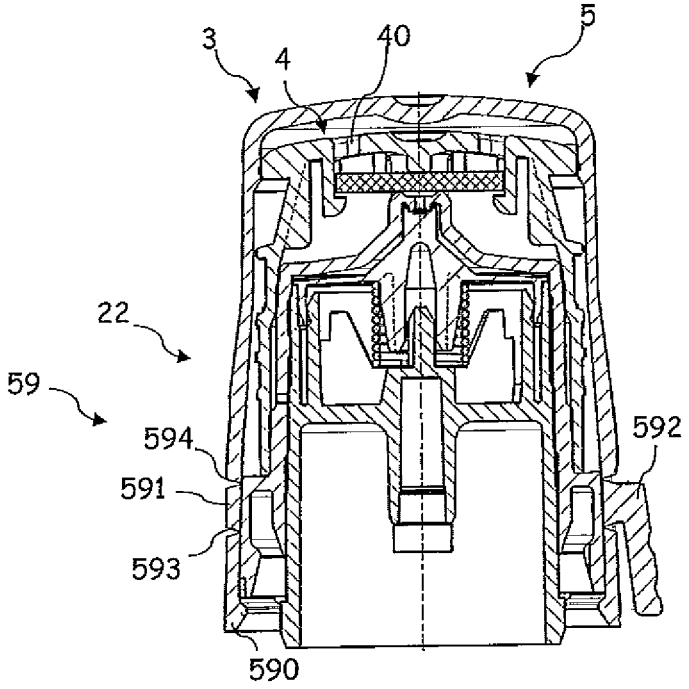
FIG. 13 shows a cross-sectional view of an alternative embodiment of an outlet assembly with a protective cap.
Figure 14:
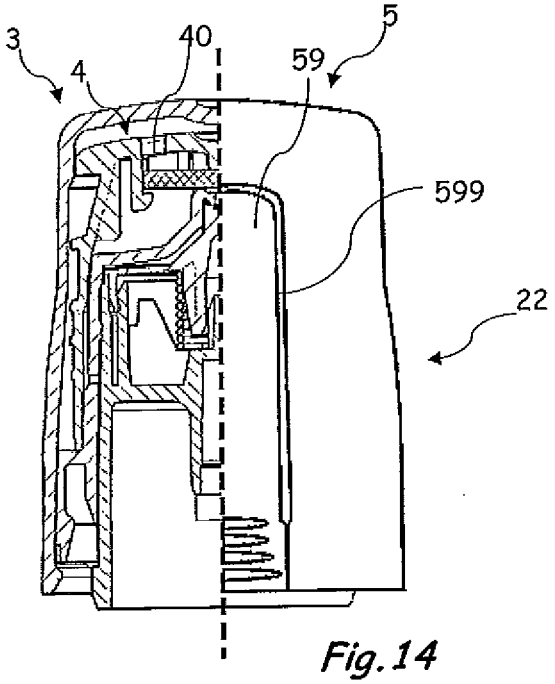
FIG. 14 shows a cross-sectional view of another alternative embodiment of an outlet assembly with a protective cap.

FIGS. 13 and 14 show cross-sectional views of alternative embodiments of a protective cap 3 fitted onto an outlet assembly 22 and comprising an inner cap 4, with ventilation openings, and an outer cap 5 fitted thereon. The protective caps 3 according to FIGS. 9 and 10 are similar to the protective cap 3 according to FIG. 8, and the same reference signs are used for identical or similar components.

In the embodiments according to FIGS. 13 and 14, by contrast to the embodiment according to FIG. 8, a tamper-evident safety device 59 is in each case provided which is formed integrally with the outer cap 5.

In the embodiment according to FIG. 13, the tamper-evident safety device 59 comprises a first segment 590 and a second segment 591, which are each ring-shaped. The second segment 591 is arranged between a substantially sleeve-shaped portion 52 of the outer cap 5 and the first segment 590. Predetermined breaking points 593, 594 are provided between the first segment 590 and the second segment 591 and also between the second segment 591 and the shoulder portion 52. A tear-open tab 592 is provided for removing the second segment 591. It is only after removal of the second segment 591 that the outer cap 5 can be pulled away from the inner cap 4 or transferred from the sealing first position to a second position. The components are dimensioned in such a way that, because of the separation of the sleeve-shaped portion 52 from the first segment 590, it is not possible for the outer cap 5 to be fitted sealingly back in place. This ensures that, from the start of a first use, the outlet opening 24 communicates with the environment via the ventilation openings 40.

In the embodiment according to FIG. 14, the tamper-evident safety device 59 is designed in the form of predetermined breaking points 599 which extend in a U-shape on the outer cap 5 and by which a pull-off tab is formed. Before a removal of the tamper-evident safety device 59, a lower edge of the outer cap 5 is latched onto a housing 220 of the outlet assembly 22, such that pulling-off of the outer cap 5 is prevented. For a better hold, the tamper-evident safety device 59 has a grip area.

The invention claimed is:

1. A discharge device comprising:

a dispenser for discharging a pharmaceutical and/or cosmetical liquid, the dispenser including a liquid reservoir and an outlet opening through which the liquid can be discharged into a surrounding atmosphere; and a protective cap removably connected to the dispenser, the protective cap comprising an inner cap and an outer cap;

wherein the inner cap has at least one ventilation opening for communication between an interior of the protective cap and an external environment;

wherein, before a first use, the outer cap is mounted on the inner cap in a first position in which the inner cap and the outer cap are sealingly in contact with each other and the at least one ventilation opening is separated in an airtight and germproof manner from the external environment;

wherein the outer cap is movable relative to the inner cap from the first position to at least a second position in which the inner cap and the outer cap are not sealingly in contact with each other and the at least one ventilation opening communicates with the external environment in an airtight and germproof manner;

wherein the dispenser further comprises an outlet channel which connects the liquid reservoir to the outlet opening, and an outlet valve which opens depending on pressure or can be manually actuated and which is arranged in the outlet channel and, in a closed state, closes the outlet channel;

wherein the inner cap covers the outlet opening when the protective cap is connected to the dispenser to prevent the liquid in the dispenser from being discharged into the surrounding atmosphere;

wherein the inner cap does not cover the outlet opening when the protective cap is not connected to the dispenser to thereby allow the liquid in the dispenser to be discharged into the surrounding atmosphere; and wherein at least one of the inner cap and the outer cap has at least one resilient blocking element that in a blocking position directly counteracts axial movement of the outer cap relative to the inner cap from the second position towards the first position.

2. The discharge device as claimed in claim 1, wherein the at least one resilient blocking element is adjustable between the blocking position, in which movement of the outer cap relative to the inner cap is blocked, and a release position, in which the outer cap is movable relative to the inner cap to the first position, wherein the at least one resilient blocking element is resiliently forced into the blocking position.

3. The discharge device as claimed in claim 2, wherein the at least one resilient blocking element is resiliently forced into the blocking position on account of elastic restoring forces.

4. The discharge device as claimed in claim 2, wherein the at least one resilient blocking element is arranged on the outer cap, and the inner cap has at least one complementary opening, wherein, in order to allow movement of the outer cap relative to the inner cap to the first position, the at least one resilient blocking element can be guided into the at least one complementary opening in the release position.

5. The discharge device as claimed in claim 1, wherein the at least one resilient blocking element is designed as a radially outwardly protruding tab.

6. The discharge device as claimed in claim 5, wherein at least one protection element is assigned to at least one of the at least one resilient blocking element in order to avoid manual operation of said at least one of the at least one resilient blocking element.

7. The discharge device as claimed in claim 1, wherein the at least one resilient blocking element is resiliently tensioned when the outer cap and the inner cap are in the first position.

8. A discharge device comprising:

a dispenser for discharging a pharmaceutical and/or cosmetical liquid, the dispenser including a liquid reservoir for holding the liquid, an outlet opening through which the liquid can be discharged into a surrounding atmosphere, an outlet channel connecting the liquid reservoir to the outlet opening, and an outlet valve in the outlet channel which opens to allow the liquid to exit the dispenser through the outlet opening and closes to prevent the liquid from exiting the dispenser; and a protective cap comprising an inner cap and an outer cap, the inner cap being removably connected to the dispenser;

wherein the inner cap has at least one ventilation opening for communication between an interior of the protective cap and an external environment;

wherein, before a first use, the outer cap is mounted on the inner cap in a first position in which the inner cap and the outer cap are sealingly in contact with each other and the at least one ventilation opening is separated in an airtight and germproof manner from the external environment;

wherein the outer cap is movable relative to the inner cap from the first position to at least a second position in which the inner cap and the outer cap are not sealingly in contact with each other and the at least one ventilation opening communicates with the external environment in an airtight and germproof manner;

wherein the outer cap is spaced from and does not engage the dispenser; and wherein at least one of the inner cap and the outer cap has at least one resilient blocking element that directly counteracts axial movement of the outer cap relative to the inner cap from the second position towards the first position.

9. The discharge device as claimed in claim 8, wherein the inner cap covers the outlet opening when the protective cap is connected to the dispenser to prevent the liquid in the dispenser from being discharged into the surrounding atmosphere; and the inner cap does not cover the outlet opening when the protective cap is not connected to the dispenser to thereby allow the liquid in the dispenser to be discharged into the surrounding atmosphere.

10. The discharge device as claimed in claim 8, wherein the at least one resilient blocking element is adjustable between a blocking position, in which movement of the outer cap relative to the inner cap is blocked, and a release position, in which the outer cap is movable relative to the inner cap to the first position, wherein the at least one resilient blocking element is resiliently forced into the blocking position.

11. The discharge device as claimed in claim 10, wherein the at least one resilient blocking element is forced into the blocking position on account of elastic restoring forces.

12. The discharge device as claimed in claim 10, wherein the at least one resilient blocking element is arranged on the outer cap, and the inner cap has at least one complementary opening, wherein, in order to allow movement of the outer cap relative to the inner cap to the first position, the at least one resilient blocking element can be guided into the at least one complementary opening in the release position.

13. The discharge device as claimed in claim 8, wherein the at least one resilient blocking element is designed as a radially outwardly protruding tab.

14. The discharge device as claimed in claim 13, wherein at least one protection element is assigned to at least one of the at least one resilient blocking element in order to avoid manual operation of said at least one of the at least one resilient blocking element.

15. The discharge device as claimed in claim 8, wherein the at least one resilient blocking element is resiliently tensioned when the outer cap and the inner cap are in the first position.

16. A discharge device comprising:

a dispenser for discharging a pharmaceutical and/or cosmetical liquid, the dispenser including a liquid reservoir and an outlet opening through which the liquid can be discharged into a surrounding atmosphere; and a protective cap removably connected to the dispenser, the protective cap comprising an inner cap and an outer cap;

wherein the inner cap has at least one ventilation opening for communication between an interior of the protective cap and an external environment;

wherein, before a first use, the outer cap is mounted on the inner cap in a first position in which the inner cap and the outer cap are sealingly in contact with each other and the at least one ventilation opening is separated in an airtight and germproof manner from the external environment;

wherein the outer cap is movable relative to the inner cap from the first position to at least a second position in which the inner cap and the outer cap are not sealingly in contact with each other and the at least one ventilation opening communicates with the external environment in an airtight and germproof manner;

wherein the dispenser further comprises an outlet channel which connects the liquid reservoir to the outlet opening, and an outlet valve which opens depending on pressure or can be manually actuated and which is arranged in the outlet channel and, in a closed state, closes the outlet channel;

wherein the inner cap covers the outlet opening when the protective cap is connected to the dispenser to prevent the liquid in the dispenser from being discharged into the surrounding atmosphere;

wherein the inner cap does not cover the outlet opening when the protective cap is not connected to the dispenser to thereby allow the liquid in the dispenser to be discharged into the surrounding atmosphere; and wherein at least one of the inner cap and the outer cap has at least one resilient blocking element that counteracts movement of the outer cap relative to the inner cap to the first position, the at least one resilient blocking element being resiliently tensioned when the outer cap and the inner cap are in the first position.

17. A discharge device comprising:

a dispenser for discharging a pharmaceutical and/or cosmetical liquid, the dispenser including a liquid reservoir for holding the liquid, an outlet opening through which the liquid can be discharged into a surrounding atmosphere, an outlet channel connecting the liquid reservoir to the outlet opening, and an outlet valve in the outlet channel which opens to allow the liquid to exit the dispenser through the outlet opening and closes to prevent the liquid from exiting the dispenser; and a protective cap comprising an inner cap and an outer cap, the inner cap being removably connected to the dispenser;

wherein the inner cap has at least one ventilation opening for communication between an interior of the protective cap and an external environment;

wherein, before a first use, the outer cap is mounted on the inner cap in a first position in which the inner cap and the outer cap are sealingly in contact with each other and the at least one ventilation opening is separated in an airtight and germproof manner from the external environment;

wherein the outer cap is movable relative to the inner cap from the first position to at least a second position in which the inner cap and the outer cap are not sealingly in contact with each other and the at least one ventilation opening communicates with the external environment in an airtight and germproof manner;

wherein the outer cap is spaced from and does not engage the dispenser; and wherein at least one of the inner cap and the outer cap has at least one resilient blocking element that counteracts movement of the outer cap relative to the inner cap to the first position, the at least one resilient blocking element being resiliently tensioned when the outer cap and the inner cap are in the first position.

* * * * *